US012564779B2

(12) United States Patent
Spiridonovs

(10) Patent No.: US 12,564,779 B2
(45) Date of Patent: Mar. 3, 2026

(54) CARD DEALING SHOE WITH A PUSHER

(71) Applicant: STROPUS LTD., Agioi Omologites Nicosia (CY)

(72) Inventor: Artjoms Spiridonovs, Agioi Omologites Nicosia (CY)

( * ) Notice: Subject to any disclaimer, the term of this patent is extended or adjusted under 35 U.S.C. 154(b) by 17 days.

(21) Appl. No.: 18/000,883

(22) PCT Filed: Sep. 21, 2021

(86) PCT No.: PCT/IB2021/058578
§ 371 (c)(1),
(2) Date: Dec. 6, 2022

(87) PCT Pub. No.: WO2022/238748
PCT Pub. Date: Nov. 17, 2022

(65) Prior Publication Data
US 2023/0211228 A1 Jul. 6, 2023

(51) Int. Cl.
*A63F 1/00* (2006.01)
*A63F 1/14* (2006.01)

(52) U.S. Cl.
CPC ..... *A63F 1/14* (2013.01)

(58) Field of Classification Search
CPC ..... A63F 1/14; A63F 1/067
USPC ..... 273/149 P, 149 R
See application file for complete search history.

(56) References Cited

U.S. PATENT DOCUMENTS 4,750,743 A * 6/1988 Nicoletti ..... A63F 1/14 271/160
5,941,769 A * 8/1999 Order ..... A63F 1/18 463/25
6,402,142 B1 * 6/2002 Warren ..... A63F 1/14 273/148 R
6,637,622 B1 10/2003 Robinson
2005/0121852 A1 * 6/2005 Soltys ..... A63F 1/18 463/9
2007/0138743 A1 * 6/2007 Fleckenstein ..... A63F 1/14 273/149 R
2007/0216092 A1 * 9/2007 Fleckenstein ..... A63F 1/14 273/148 R
2013/0228971 A1 * 9/2013 Flynn ..... A63F 1/14 273/149 R (Continued)

FOREIGN PATENT DOCUMENTS

WO 2014064868 A1 5/2014
WO WO-2016049619 A1 * 3/2016 ..... A63F 1/14

OTHER PUBLICATIONS

ISR; European Patent Office; NL; Jun. 14, 2022.

*Primary Examiner* — Kiley S Stoner
(74) *Attorney, Agent, or Firm* — Patshegen IP; Moshe Pinchas

(57) ABSTRACT

The present invention relates to a device to hold playing cards in position to allow them to be dealt out one at a time. A dealing shoe comprises a shoe body configured to receive plurality of playing cards, a front panel, through which the playing cards received in the shoe body are dealt out, and a lip extending outside the shoe body in the front of the front panel of the shoe body. The dealing shoe further comprises a pusher arranged within the shoe body. The dealing shoe is characterized in that the lip comprises a scanner hole facilitating the scan of dealt cards, and a docking station allowing removable and secure attachment of the dealing shoe to the dealing table.

11 Claims, 4 Drawing Sheets

(56) References Cited

U.S. PATENT DOCUMENTS

| | | | | |
|---|---|---|---|---|
| 2014/0042697 | A1* | 2/2014 | Berube | A63F 1/14 273/149 R |
| 2014/0091523 | A1* | 4/2014 | Madding | A63F 1/10 273/149 R |
| 2014/0291930 | A1* | 10/2014 | Berube | A63F 1/14 273/149 R |
| 2015/0328533 | A1* | 11/2015 | Haushalter | A63F 1/12 273/149 R |
| 2016/0014351 | A1* | 1/2016 | Blazevic | A63F 1/02 250/330 |
| 2016/0059112 | A1 | 3/2016 | Real | |
| 2017/0095727 | A1* | 4/2017 | Shigeta | A63F 1/14 |
| 2017/0113126 | A1* | 4/2017 | Scheper | A63F 1/14 |
| 2017/0173448 | A1* | 6/2017 | Martino | A63F 1/14 |
| 2022/0233735 | A1* | 7/2022 | Whittemore | A61L 2/10 |
| 2022/0409986 | A1* | 12/2022 | Van Genechten | A63F 1/062 |
| 2023/0211228 | A1* | 7/2023 | Spiridonovs | A63F 1/14 273/149 R |

* cited by examiner

CARD DEALING SHOE WITH A PUSHER

FIELD OF THE INVENTION

The present invention relates to a device to hold playing cards in position to allow them to be dealt out one at a time.

BACKGROUND OF THE INVENTION

A dealing shoe or dealer's shoe is a gaming device, mainly used in casinos, to hold multiple decks of playing cards. The shoe allows for more games to be played by reducing the time between shuffles and less chance of dealer cheating.

The U.S. Pat. No. 4,457,512 discloses a dealing shoe for playing cards in the form of a box having a sloping front wall with a finger opening therein communicating with a slot horizontally disposed at a lower edge of the front wall for passage of cards therethrough. A downwardly inclined support plate is disposed within the box and slidably supports a pusher which serves to push the cards toward the front wall. Springs are employed to resiliently bias the pusher toward the front wall. Similar designs are disclosed in US patent application publication No. US2017/0259164 and U.S. Pat. No. 6,637,622.

Aforementioned dealing shoes are conventional shoes are not suitable for online gaming like online casino or live online gaming. In online gaming the cards taken out of the dealing shoe are to be immediately scanned to synchronize with the software and digital version of the live-game. Often errors and game delays occur due to equipment and/or employees' incorrect interaction with the equipment and cards. Hence, it is necessary to design a special dealing shoe which is suitable for online gaming allowing un-interrupted play and reducing errors.

SUMMARY OF THE INVENTION

The aim is reached by a design of a dealing shoe comprising a shoe body configured to receive plurality of playing cards. The shoe body comprises a base plate, three walls extending from the base plate and a front panel, through which the playing cards received in the shoe body are dealt out. The base plate comprises a lip extending outside the shoe body in the front of the front panel of the shoe body. The dealing shoe further comprises a pusher arranged within the shoe body. The pusher comprises a pusher wheel rotatably connected to the pusher.

One distinguishing feature of the present invention is that the front panel in relation to the base plate is inclined at an angle of 34 to 38 degrees, preferably 36 degrees, and in that the face of the pusher in relation to the base plate of the shoe body is inclined at an angle of 39 to 41 degrees, preferably 40 degrees. Basically, the angle between the front panel of the shoe body and the base plate of the shoe body is more acute than the angle between the face of the pusher and the base plate of the shoe body. As opposed to industry standard where the front panel of the dealing shoe together with the face of the pusher make parallel lines and hence the same angles, however in case of the present invention the angles differ measured against the base plate. This technical feature reduces "2-card" cases. Naturally the shoe must be fixed approximately twice per game on a full Blackjack table. "Shoe fixing" is a process, where you tidy up the cards. However, with the help of the converging angle, the cards do not need to be fixed. In addition, a heavier than a normal pusher wheel further facilitates this technical effect. The normal or standard pusher weights at about 400 grams, wherein the pusher of the present invention weights at about 600 grams and more, preferably about 800 grams. These features help the cards slide into their natural position. On the prior art shoe, after cards get dealt out, the cards become less packed, there is less pressure between them etc., As a result of this there is a need to manually pack them back together, otherwise more than one card can come out of the shoe, which disturbs the game. In the present invention there is no need to fix the dealing shoe at all.

The lip comprises lip hole, which makes it very difficult for a card to be extracted without its full barcode value being visible underneath. Further a scanner is integrated right under the lip of the shoe. As opposed to industry standard of it being in front of the shoe lip. This new design provides more secure card scanning in the card-dealing process.

The lip further comprises thumb areas made on each side of said lip in the form of curved or rounded sides. These thumb areas provide more efficient card extraction.

The dealing shoe further comprises a shoe base arranged below the shoe body and the shoe base comprises a set of magnets. The dealing shoe is further attachable to a docking station configured to be separately and stationary fixed to the table. The docking station comprises a set of magnets and the docking station is configured to be interconnected with the shoe base by means of magnets. The shoe base further comprises docking extensions, which surround the docking station upon assembly thereof so that any relative side or sidewards movement between the dealing shoe and docking station is avoided. The dealing shoe can only be removed upwards, which reduces risks of game errors and card faults during the play.

This developed dealing shoe and the pusher combination has been specifically tailored for live casino play. Often errors and game delays occur due to equipment and/or employees' incorrect interaction with the equipment and cards. This dealing shoe significantly reduces the error rate of what the industry standard currently is.

The dealing shoe as an equipment is used in such games as Blackjack and Baccarat, however it may be suitable also for other shoe-games. Moreover, there are games like pokers, where this shoe also may be used.

BRIEF DESCRIPTION OF THE DRAWINGS

The drawings illustrate generally, by way of example, but not by way of limitation, various embodiments of the invention.

DETAILED DESCRIPTION OF THE EMBODIMENTS

The preferred embodiments of the invention are now described with reference to the figures to illustrate objectives, advantages, and efficiency of the present invention.

Figure 1:
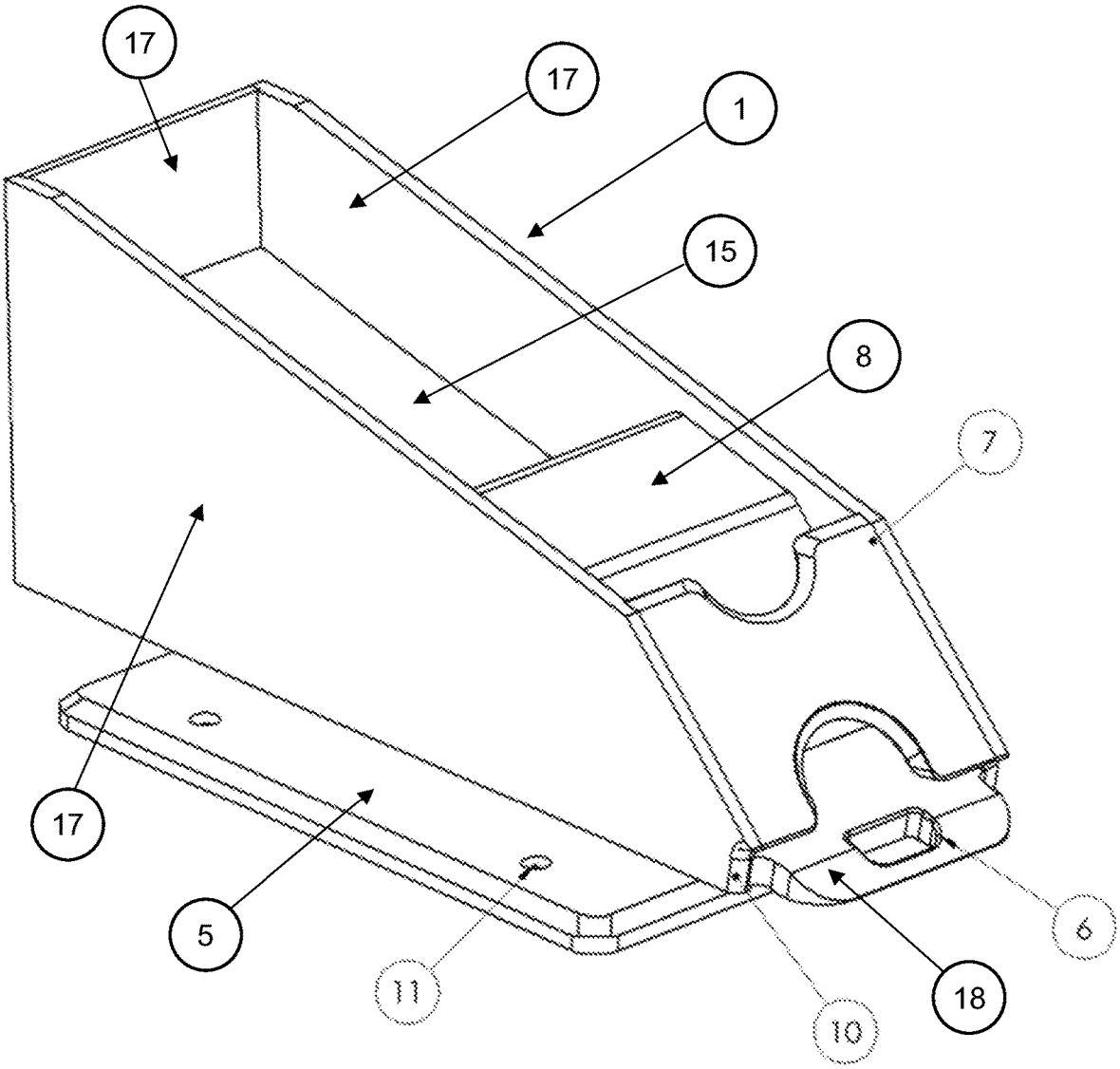
FIG. 1 is a perspective view schematically showing a card dealing shoe with a pusher (8) and a docking station (5).
Figure 2:
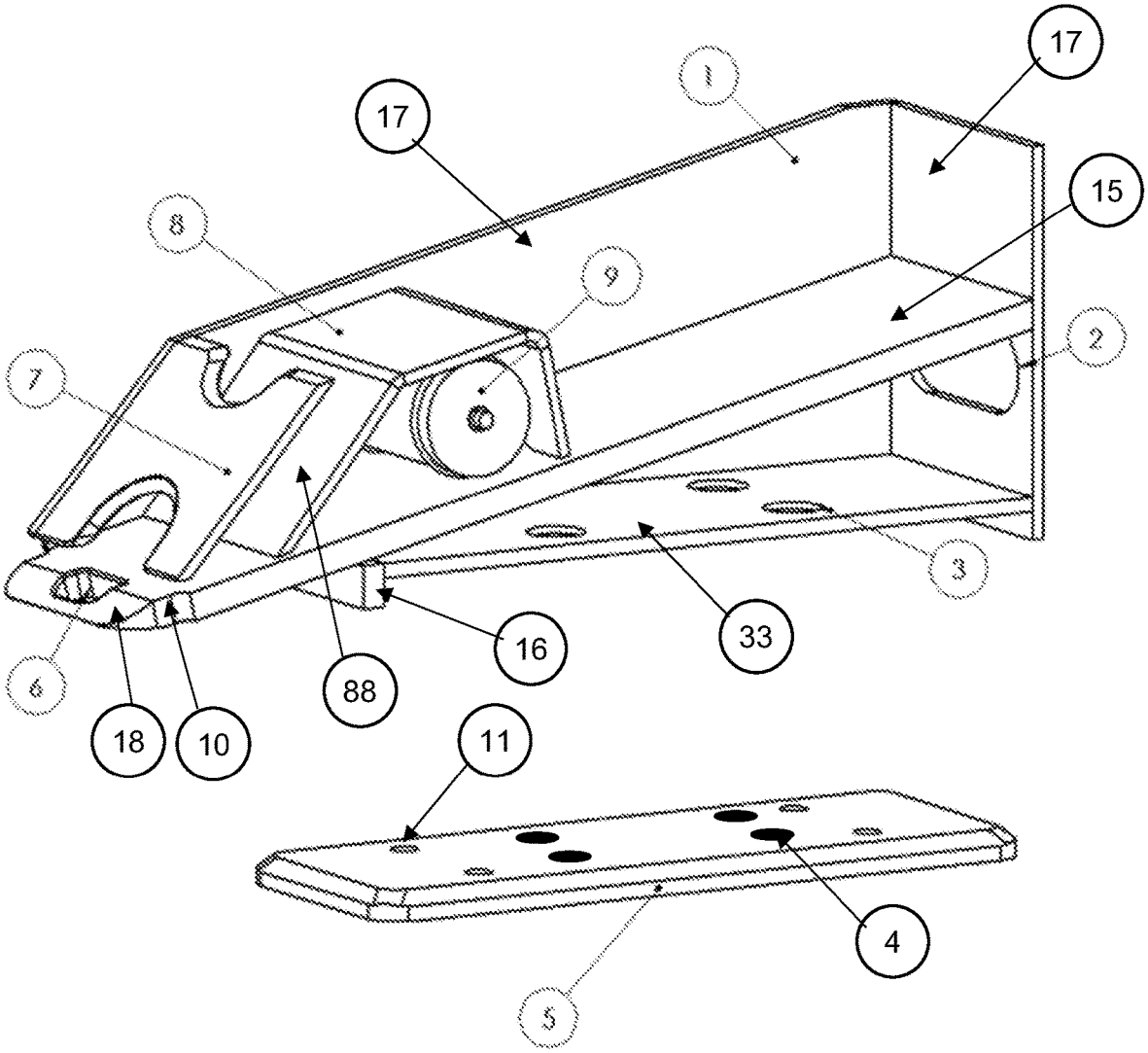
FIG. 2 is a perspective view schematically showing a card dealing shoe with a pusher (8) and a docking station (5), wherein for ease of understanding one wall (17) of the shoe body (1) is removed.

A dealing shoe comprises a shoe body (1) configured to receive plurality of playing cards. The shoe body (1) comprises a base plate (15), three walls (17) extending from the base plate (15) and a front panel (7), through which the playing cards received in the shoe body (1) are dealt out. The base plate (15) comprises a lip (18) extending outside from the shoe body (1) in the front of the front panel (7) of the shoe body (1). Moreover, the lip (18) on each of its sides comprises thumb areas (10) so that the lip (18) is narrower than the width of the shoe body (1) or a length of a playing card. In addition, the thumb areas (10) are in the form of curved or rounded sides. The thumb areas (10) allow more efficient card extraction. The lip (18) further comprises a lip hole (6). The dealing shoe further comprises a pusher (8) arranged within the shoe body (1) so that the pusher can move within the shoe body (1). The pusher (8) comprises a pusher wheel (9) rotatably connected to the pusher (8) further facilitating a movement of the pusher (8) within the shoe body (1) (See FIGS. 1 and 2).

The dealing shoe is attached to a playing table (12) by means of a shoe base (33) and a docking station (5). The shoe base (33) is arranged below the shoe body (1) and the shoe base (33) comprises a set of magnets (3). The docking station (5) is arranged at the playing table (12) and configured to be fixed to said playing table (12) by means of screws and base mounting holes (11). The tables base (5) further comprises a set of magnets (4). Set of magnets (3) of the shoe base (33) and set of magnets (4) of the docking station (5) are positioned so that upon placement of the dealing shoe with its shoe base (33) on the docking station (5) these magnets (3 and 4) attach to each other. Moreover, the shoe base (33) comprises docking extensions configured to engage with the docking station (5) in a such a manner that any relative side movement between the dealing shoe and docking station (5) is avoided (see FIGS. 1 and 2).

Figure 3:
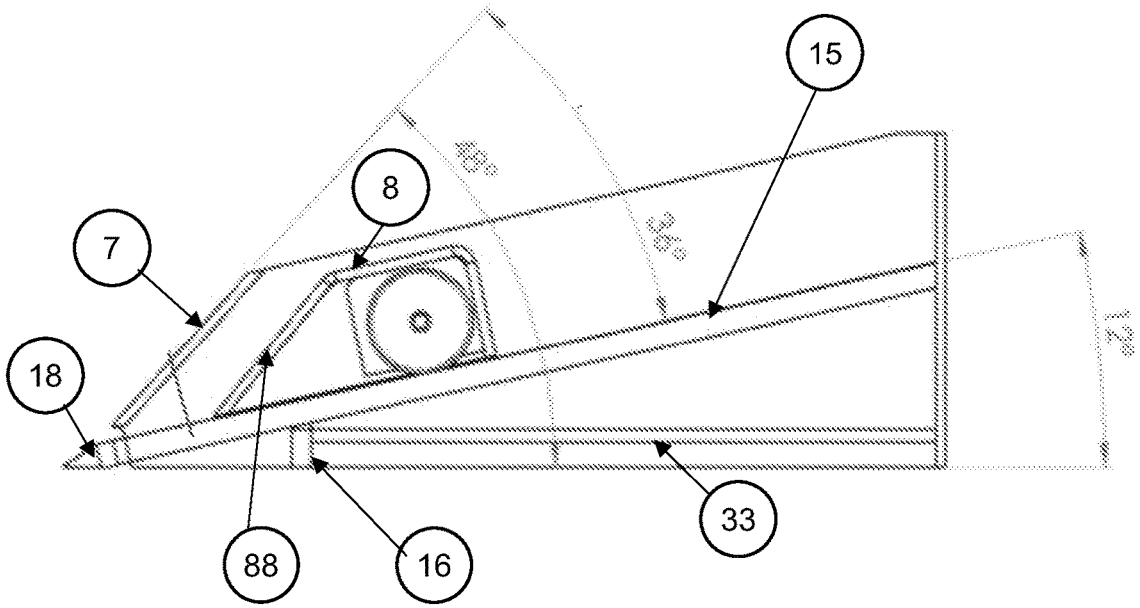
FIG. 3 is a side view of a card dealing shoe with a pusher (8) with removed one wall (17) of the shoe body (1) to illustrate interrelated angles of a front panel (7), a base plate (15), a face (88) of a pusher (8) and a base plate (15) of the shoe body (1).

The present invention is characterized in that the front panel (7) in relation to the base plate (15) is inclined at an angle of 36 degrees. The front panel (7) in relation to the shoe base (33) is inclined at an angle of 48 degrees. The base plate (15) of the shoe body (1) in relation to the shoe base (33) is inclined at an angle of 12 degrees (see FIG. 3).

Figure 4:
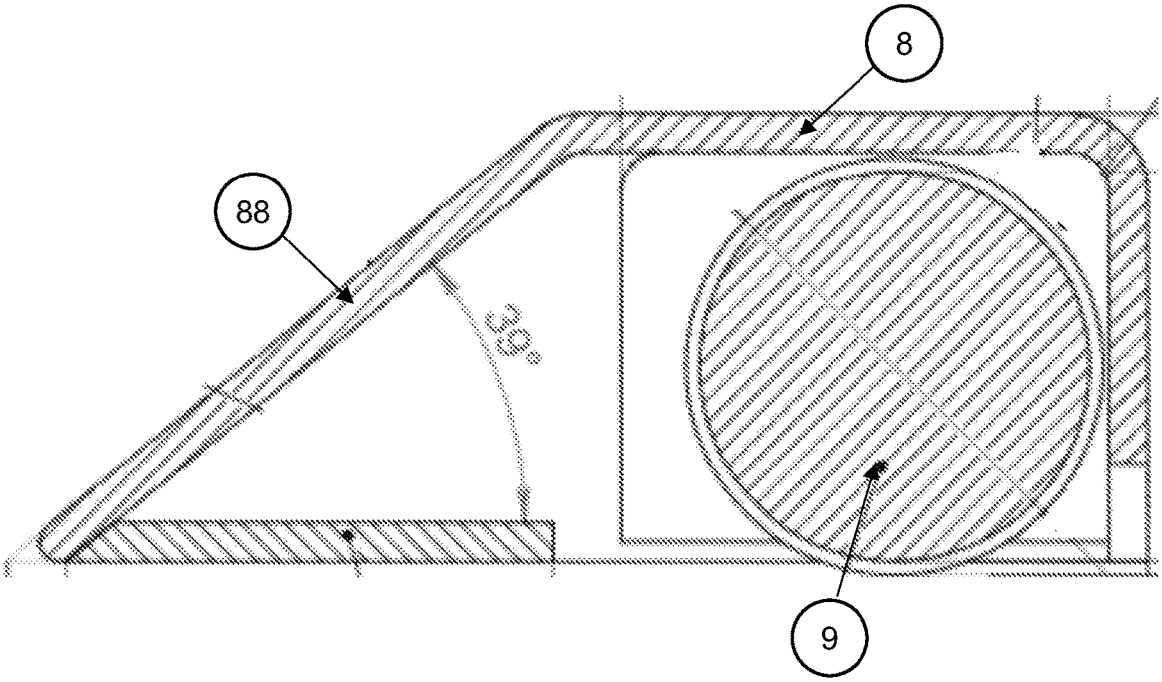
FIG. 4 is a sectional view schematically showing a pusher (8) with a pusher wheel (9).
Figure 6:
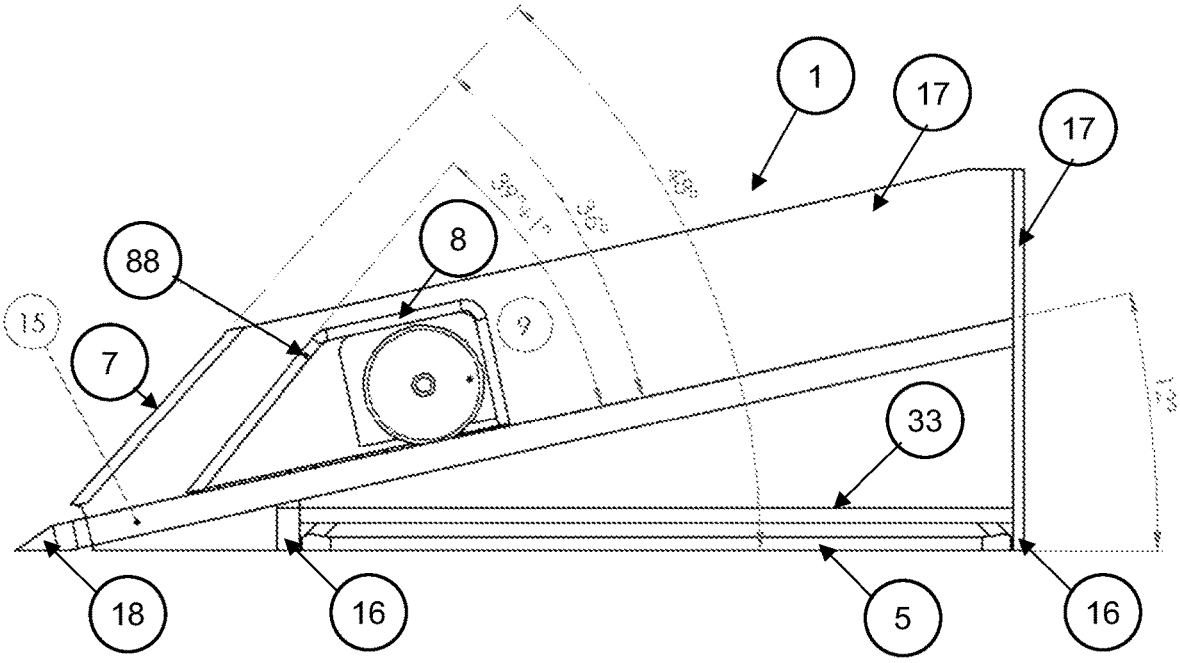
FIG. 6 is a side view of a card dealing shoe with a pusher (8) with removed one wall (17) of the shoe body (1) for ease of understanding interrelated angles of a front panel (7), a base plate (15), a face (88) of a pusher (8) and a base plate (15) of the shoe body (1). Moreover, the dealing shoe (1) is attached to a docking station (5).

The face (88) of the pusher (8) in relation to the base plate (15) of the shoe body (1) is inclined at an angle 40 degrees. In FIG. 4 it is illustrated that the face (88) of pusher (8) in relation to the base of the pusher (8), which slides along the same base plate (15), is at the angle of 39 degrees. One additional degree comes from the pusher wheel (9) which inclines even further the face (88) of the pusher (8) in relation to the base plate (15) as seen in FIG. 6.

Figure 5:
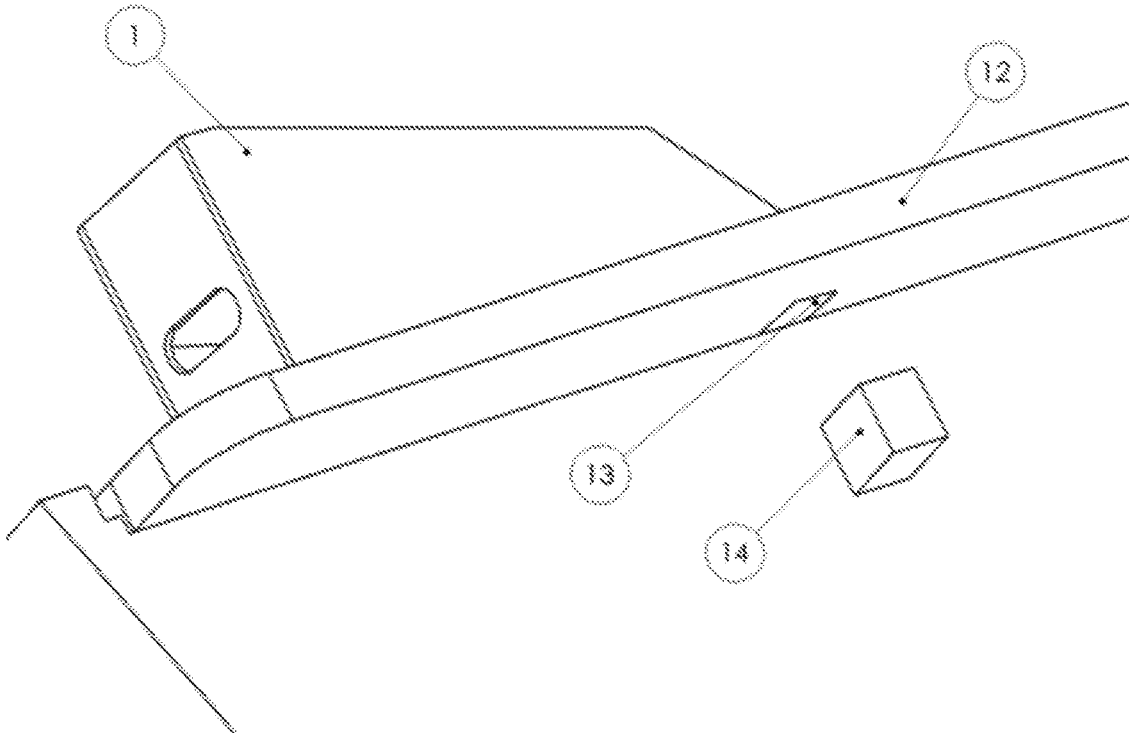
FIG. 5 is a perspective view schematically showing a shoe body (1) attached to the playing table (12) with a scanner (14) under the playing table (12) and a scanner hole (13) allowing to scan cards dealt from the dealing shoe (1) by means of the scanner (14).

The playing table (12) comprises a scanner window (13) and a scanner (14) installed under the table (12). The scanner (14) is positioned under the playing table (12) and near the scanner window (13) so that the scanner (14) can scan through the scanner window (13) and the lip hole (6) the playing cards dealt out of the dealing shoe (see FIG. 5).

The shoe body (1) is removably attachable to the table (12) via the docking station (5). The docking station (5) is configured so that the shoe body (1) with its docking extensions (16) firmly positions on the docking station (5). This combination of the features eliminates any side movement of the shoe body (1) in result of which the cards may be drawn out and scanned more reliably. (see FIGS. 1, 2 and 6).

While the invention may be susceptible to various modifications and alternative forms, specific embodiments of which have been shown by way of example in the figures and have been described in detail herein, it should be understood that the invention is not intended to be limited to the particular forms disclosed. Rather, the invention includes all modifications, equivalents, and alternatives falling within the scope of the invention as defined by the following claims.

LIST OF REFERENCES

1—a shoe body;
2—a removal handle;
3—a magnet of a shoe base;
33—a shoe base;
4—a magnet of a docking station;
5—a docking station;
6—a lip hole;
7—a front panel;
8—a pusher;
88—a face of a pusher;
9—a pusher wheel;
10—a thumb area;
11—a base mounting hole;
12—a playing table;
13—a scanner window;
14—a scanner;
15—a base plate;
16—docking extensions;
17—a wall of a shoe body; and
18—a lip.

The invention claimed is:

1. A dealing shoe comprising: a shoe body configured to receive plurality of playing cards, wherein the shoe body comprises a base plate, three walls extending from the base plate and a front panel, through which the playing cards received in the shoe body are dealt out, and the base plate comprises a lip extending outside the shoe body in front of the front panel of the shoe body, a pusher arranged within the shoe body, wherein the pusher comprises a pusher wheel rotatably connected to the pusher, a shoe base arranged below the shoe body, and the shoe base comprises a set of magnets, characterized in that the front panel (7) in relation to the base plate (15) is inclined at an angle of 34 to 38 degrees, and in that a face (88) of the pusher (8) in relation to the base plate (15) of the shoe body (1) is inclined at an angle of 39 to 41 degrees, and in that the lip (18) comprises a lip hole (6) and thumb areas (10) are made on each side of the lip (18) in a form of rounded sides.

2. The dealing shoe according to claim 1, characterised in that it further comprises a docking station configured to be fixed to a table, wherein the docking station comprises a set of magnets and the docking station is configured to be interconnected with the shoe base by means of magnets, and wherein the shoe base further comprises docking extensions which surrounds the docking station upon assembly thereof so that any relative side movement between the dealing shoe and docking station is avoided.

3. The dealing shoe according to claim 1 characterized in that the front panel in relation to the shoe base is inclined at an angle of 47 to 49 degrees.

4. The dealing shoe according to claim 1, characterized in that the base plate of the shoe body in relation to the shoe base is inclined at an angle of 11 to 13 degrees.

5. A playing table comprising the dealing shoe according to claim 1, wherein the playing table comprises a scanner window and a scanner installed under the playing table and positioned so that the scanner can scan the playing cards dealt out of the dealing shoe through the scanner window and the lip hole.

6. The playing table comprising the dealing shoe according to claim 1, wherein the weight of the pusher is at least 600 grams.

7. The dealing shoe according to claim 1, wherein the front panel (7) in relation to the base plate (15) is inclined at an angle of 36 degrees.

8. The dealing shoe according to claim 1, wherein the face (88) of the pusher (8) in relation to the base plate (15) of the shoe body (1) is inclined at an angle of 40 degrees.

9. The dealing shoe according to claim 3, wherein the front panel in relation to the shoe base is inclined at an angle of 48 degrees.

10. The dealing shoe according to claim 4, wherein the base plate of the shoe body in relation to the shoe base is inclined at an angle of 12 degrees.

11. The playing table according to claim 6, wherein the weight of the pusher is at about 800 grams.

* * * * *